US008154574B2

(12) United States Patent
Neuhard et al.

(10) Patent No.: US 8,154,574 B2
(45) Date of Patent: Apr. 10, 2012

(54) HAND-HELD PORTABLE PRINTER SYSTEM AND METHOD

(75) Inventors: Lance D. Neuhard, New Carlisle, OH (US); Clyde N. Tharp, Dayton, OH (US)

(73) Assignee: Avery Dennison Corporation, Pasadena, CA (US)

( * ) Notice: Subject to any disclaimer, the term of this patent is extended or adjusted under 35 U.S.C. 154(b) by 176 days.

(21) Appl. No.: 12/256,888

(22) Filed: Oct. 23, 2008

(65) Prior Publication Data

US 2010/0103238 A1 Apr. 29, 2010

(51) Int. Cl.
*B41J 2/32* (2006.01)

(52) U.S. Cl. ..... 347/197; 347/222

(58) Field of Classification Search ..... 347/197, 347/222

See application file for complete search history.

(56) References Cited

U.S. PATENT DOCUMENTS

| | | | |
|---|---|---|---|
| 5,483,624 | A | 1/1996 | Christopher et al. |
| 5,486,259 | A | 1/1996 | Goodwin et al. |
| 5,793,032 | A | 8/1998 | Bard et al. |
| 5,804,807 | A | 9/1998 | Murrah et al. |
| 6,327,972 | B2 | 12/2001 | Heredia et al. |
| 6,409,401 | B1 | 6/2002 | Petteruti et al. |
| 6,467,688 | B1 | 10/2002 | Goldman et al. |
| 6,484,933 | B1 | 11/2002 | Zimmerman et al. |
| 6,652,170 | B1 | 11/2003 | Arnold |
| 6,761,316 | B2 | 7/2004 | Bridgelall et al. |
| 6,775,034 | B1 | 8/2004 | Morford |
| 6,830,181 | B1 | 12/2004 | Bennett |
| 6,916,128 | B1 | 7/2005 | Petteruti et al. |
| 6,991,159 | B2 | 1/2006 | Zenou |
| 7,180,627 | B2 | 2/2007 | Moylan et al. |
| 7,416,129 | B2 | 8/2008 | Bhatia et al. |
| 7,609,406 | B2 * | 10/2009 | Roth et al. ..... 358/1.15 |
| 2001/0045452 | A1 | 11/2001 | Momose et al. |
| 2005/0280537 | A1 | 12/2005 | Feltz et al. |
| 2006/0221363 | A1 | 10/2006 | Roth et al. |
| 2007/0013520 | A1 | 1/2007 | Conwell et al. |

FOREIGN PATENT DOCUMENTS

| | | |
|---|---|---|
| EP | 0571734 | 12/1993 |
| EP | 0996084 | 4/2000 |
| JP | 2007-219805 | 8/2007 |

OTHER PUBLICATIONS

JP2007219805 Publication English language Abstract.

JP2007219805 Machine translation; (No representation or warranty is being provided as the the accuracy or completeness of the machine translation).

U.S. Appl. No. 60/193,282; Petteruti; Filing date Mar. 30, 2000; Portable Printer With RFID Encoder.

(Continued)

*Primary Examiner* — Huan Tran

(74) *Attorney, Agent, or Firm* — Avery Dennison Corporation

(57) ABSTRACT

There is disclosed a hand-held portable printer having an internal antenna, convertible to an RFID printer capable to receiving RFID data from a scanner coupled to the printer. The printer preferably shares a common RFID reader/writer with an RFID scanner. The scanner has an external antenna which can be coupled to and preferably attached to the printer. The scanner preferably includes the RFID reader/writer. The internal antenna is close to but separate from the printer's print head and the internal antenna is movable as a unit with the print head.

43 Claims, 14 Drawing Sheets

OTHER PUBLICATIONS

U.S. Appl. No. 60/338,870; Petteruti; Filing date Dec. 7, 2001; Printer Attachable to Various Models and Types of Portable Devices and Terminals for Operation Therewith.
Alien ALR-9780 Reader; 2 pages; Alien Technology; Copyright 2005.
Skyetech Skyeread Ml; 1 page; SkyeTek, LLC.
Skye Module M9; 2 pages; SkyeTek, Inc.; Copyright 2005-2006.
HMC226/226E Brochure; 6 pages; Hittite Microwave Corporation.
IP4 Portable RFID Reader Product Profile; Intermec Technologies; Copyright 2007.

* cited by examiner

HAND-HELD PORTABLE PRINTER SYSTEM AND METHOD

CROSS-REFERENCE TO RELATED APPLICATIONS

U.S. patent application Ser. No. 11/899,892 is a related application.

INCORPORATION BY REFERENCE

The disclosures of all of the following co-owned patent documents are incorporated herein by reference in their entireties: U.S. Pat. Nos. 5,486,259; 7,180,627; U.S. patent application Ser. Nos. 11/383,363; 10/873,979; 11/726,259; 11/801,281; 11/901,128; and 11/998,757.

BACKGROUND

1. Field

This invention relates to both RFID and non-RFID portable printers and to method and apparatus of enabling an RFID printer or a non-RFID printer to read and/or write to RFID transponders disposed outside the printer. The expression "RFID" is short for radio frequency identification.

2. Brief Description of the Prior Art

The following documents which may or may not be prior art are made of record: U.S. Pat. Nos. 5,483,624; 5,486,259; 5,793,032; 6,327,972; 6,409,401; 6,652,170; 6,761,316; 6,830,181; 6,916,128; 5,804,807; 6,467,688; 6,484,933; 6,775,034; 6,991,159; 7,180,627; 7,416,129; U.S. Provisional Application 60/193,282; U.S. Provisional Application No. 60/338,870; U.S. patent application Ser. Nos. 09/877,015; 10/873,979; 11/365,480; 11/383,363; EP 0 571 734 A1; EP 0 996 084 A2; brochure of Alien ALR-9780; brochure of "SkyTech SkyeRead M1; Brochure Skye Module M9 of SkyeTech, Inc., copyright 2005-2006; six page brochure pages entitled HMC 226/226E of Hittite Microwave Corporation, Chelmsford, Mass.; and IP4 Portable RFID Reader (UHF) Product Profile Brochure printed Mar. 7, 2007 Intermec Technologies Corporation. Additional references to prior art are to be found under the heading "Detailed Description of the Preferred Embodiments".

SUMMARY

There is disclosed an improved portable, hand-held printer capable of reading and/or writing to RFID transponders on record members in or internal to the printer and of printing data on those record members and which can be converted or retrofitted by the user to read and/or write to RFID transponders external to the printer. The conversion can be accomplished by coupling or releasably attaching an external RFID antenna to the printer in a location where the external antenna does not interfere with either loading of the printer with labels or use of the printer. The antenna can be housed on or in an RFID scanner or scanner attachment to the printer. If desired, an RFID reader/writer or module can also be mounted on or in the RFID scanner. It is preferred to attach the RFID scanner to a handle of the printer housing. It is also preferred that the printer have an applicator by which labels printed by the printer can be applied to articles to be labeled. The printer can be operated selectively either with the RFID scanner to receive or transmit RFID data, or without the scanner. Because the printer has an internal antenna, when the RFID scanner is coupled to the printer, the printer can also read and/or write to record members inside the printer. This coupling can be achieved by attaching the RFID scanner directly to the printer whereupon the scanner is connected to the internal antenna and to the printer's controller, or a separate RFID scanner spaced from the printer can be cable-connected or coupled to the internal RFID antenna and to the printer's controller.

It is an aspect of an embodiment to provide an external scanner or scanner attachment to a hand-held portable labeler with a housing having a handle, space to receive a supply roll of labels releasably adhered to a carrier web, a print head to print on the labels, a delaminator to delaminate printed labels from the carrier web, and a label applicator to apply printed labels. The scanner can include an RFID antenna and can be releasably attached to the handle at a location remote from the applicator so as not to interfere with the application of a printed label by the applicator or use of the labeler. The scanner can also be attached to the printer at an additional location or at alternative locations, if desired.

It is another aspect of the disclosed embodiment that an RFID antenna is mounted close to but separate from the print head. This offers advantages over an antenna and a print head that are mechanically integrated or of essentially one-piece construction because that would make for a special, unique and more expensive construction and would require replacement of both the print head and the antenna in the event either one become worn out, damaged or defective. It is preferred to mount the RFID antenna and the print head resiliently. It is also preferred to have the RFID antenna and the print head move as a unit when the print head and platen roll are brought into printing cooperation. In one preferred embodiment the print head is mounted on a first holder and the RFID antenna is mounted on a second holder which in turn is mounted to the first holder. The first and second holders preferably move as a unit.

In accordance with the disclosure, a printer can comprise a housing having first and second housing sections movable relative to each other between an open position and a closed operating position, a print head assembly yieldably mounted to the first housing section, the print head assembly including a heat sink and a print head, the print head including a linear array of heating elements on a substrate, the substrate being secured to the heat sink, a platen roll mounted on the second housing section and cooperable with the print head to print on a web of RFID transponder-containing record members movable along a web path, an RFID antenna on the first housing section, and the print head assembly and the antenna being coupled to yield as a unit as the housing sections are brought into the operating position. There is preferably a holder for the antenna, and the holder being coupled to the heat sink and movable as a unit with the heat sink. Preferably, the first housing section includes a first holder, there being at least one spring biasing the print head assembly with respect to the first holder and a second holder for the antenna which can be coupled to the heat sink and is movable as a unit with the heat sink.

In accordance with the disclosure, a printer can comprise a print head assembly including a thermal print head and a heat sink secured to the print head, a platen roll, the print head assembly and the platen roll being relatively movable between an open, spaced apart, non-operating position and a printing position with the print head in printing cooperation with the platen roll, at least one spring to enable the print head assembly to yield when the print head assembly is moved toward the printing position, a holder being connected to move in unison with the print head assembly, a circuit board mounted on the holder, the circuit board having an antenna disposed immediately upstream of the print head, the print head being capable of printing on a web of RFID transponder-containing record members movable downstream along a path past the antenna to the print head, and the print head and the antenna being on the same side of the path.

In accordance with the disclosure, a printer can comprise a thermal print head, a first holder to yieldably mount the print head, a second holder carried by the first holder, and an RFID antenna mounted to the second holder and disposed adjacent the print head.

In accordance with the disclosure, a printer can comprise a thermal print head capable of printing on a web of RFID record members movable along a path of web travel, a platen roll cooperable with the print head, a housing having first and second housing sections movable relative to each other between an open position wherein the print head and platen roll are out of printing cooperation and a closed operating position wherein the print head and platen roll are in printing cooperation, the print head being yieldably mounted by the first housing section to move as the first and second housing sections are brought to the closed position, the platen roll being mounted to the second housing section, and an RFID antenna separate from but close to the print head and connected to move in unison with the print head as the print head yields.

In accordance with the disclosure, a printer can comprise a resiliently mounted thermal print head including a substrate and a linear array of heating elements on the substrate, the heating elements being disposed along one side of a path of travel of a web of RFID record members, an internal RFID antenna separate from the substrate and closely spaced with respect to the path, wherein the antenna is disposed upstream of and close to the heating elements, wherein the antenna is disposed on the one side of the path, and a platen roll disposed on the other side of the path and cooperable with the heating elements, and a delaminator disposed along the path downstream of the platen roll. Preferably, the printer can also include a hand-held portable printer housing, the printer housing having space to mount the web of labels releasably adhered to a carrier web in the form of a supply roll, the printer housing mounting the thermal print head and the internal RFID antenna, the printer housing having a downwardly extending handle, an RFID scanner housing, an RFID antenna on the scanner housing, and the scanner housing being attached to the handle.

In accordance with the disclosure, a printer can comprise a frame, a path of travel for a web of RFID transponder-containing record members, a print head disposed along one side of the path and capable of printing on the record members, an RFID antenna disposed on the same side of the web as the print head, the RFID antenna being disposed along the path upstream of the print head, the RFID antenna being close to but separate from the print head, and wherein the print head and the RFID antenna are resiliently mounted with respect to the frame.

In accordance with the disclosure, a printer can comprise a hand-held portable printer housing having a manually engageable handle, the printer housing having space to mount a composite web of labels releasably adhered to a carrier web in the form of a supply roll, a print head mounted on the printer housing, a driven roll capable of advancing the composite web to the print head, an RFID antenna housing attached to the handle, an RFID antenna on the antenna housing, and a latch capable of releasably connecting the antenna housing to the printer housing. Preferably, the latch can be comprised of a pair of relatively movable jaws on the antenna housing engageable with the handle. Preferably, the jaws can be spring-urged into a latching position. Preferably, the handle has internal surfaces with which the jaws can engage. Preferably there can be an RFID reader/writer mounted on the antenna housing and connected to the RFID antenna. As is preferred, a battery on the printer housing may power the printer and the RFID reader/writer. Preferably, an RFID reader/writer on the printer housing is connected to the RFID antennas, and a controller on the printer housing and coupled to the RFID reader/writer can operate the print head to print on the labels. Preferably, the antenna housing can be releasably latched to the handle by the latch. Preferably the antenna housing can have a pair of housing portions in an angle-shaped arrangement, wherein the handle can extend downwardly, wherein one housing portion can underlie the handle, and wherein the other housing portion can be disposed in front of the handle and can contain the antenna in the antenna housing.

In accordance with the disclosure, an attachment including an RFID antenna, a hand-held portable printer housing can have a handle and space to receive a supply roll of labels releasably adhered to a carrier web, a print head to print on the labels, a delaminator to delaminate printed labels from the carrier web, and a label applicator to apply printed labels, and wherein the attachment is releasably attachable to the handle at a location remote from the applicator.

In accordance with the disclosure, a printer can comprise a hand-held portable printer housing having a first housing section and a second housing section, the second housing section having a downwardly extending handle, a print head mounted on one of the first and second housing sections, a platen roll mounted on the other of the first and second housing sections, the first and second housing sections being relatively movable between an open position to receive a supply roll of a composite web of labels releasably adhered to a carrier web and an operating position in which the print head is in printing cooperation with the platen roll and a label, an RFID antenna housing, an RFID antenna on the antenna housing, and wherein the antenna housing is attached to the handle. Preferably, the antenna housing is releasably attached to the handle.

In accordance with the disclosure, a printer can comprise a hand-held portable printer housing, the printer housing having space to mount a composite web of labels releasably adhered to a carrier web in the form of a supply roll, the housing having a downwardly extending handle, a print head mounted in the printer housing, a driven roll capable of advancing the composite web to the print head, an RFID antenna housing, an RFID antenna on the antenna housing, and the antenna housing being connected to the handle. Preferably, the printer housing can have an exit opening through which the carrier web can exit, and the antenna housing being disposed below the exit opening. Preferably, the antenna housing can be attached to the lower region of the handle. Preferably, one part of the antenna housing can be disposed below the handle and another part of the antenna housing can be disposed in front of the handle. Preferably, the one part of the antenna housing can have a pair of manually operable jaws engageable with the handle. Preferably, an applicator on the printer housing can apply printed labels.

In accordance with the disclosure, a printer can comprise a printer housing, a print head on the printer housing, the print head being capable of printing on a web of RFID transponder-containing record members movable along a path of web travel, an internal RFID antenna capable of communicating by radio frequency with transponders on the web, an RFID scanner housing coupled to the outside of the printer housing, an RFID reader/writer, the RFID reader/writer being disposed on the scanner housing, an external RFID antenna on the scanner housing, and wherein the internal RFID antenna and external RFID antenna are coupled to the RFID reader/writer. The printer housing can be hand-held and portable and include a handle, and wherein the scanner housing can be attached to the handle. The printer can have a latch connecting the printer housing and the scanner housing. The internal antenna can be comprised of either a UHF antenna or a HF antenna. The external antenna can be comprised of either a UHF antenna or an HF antenna. There is preferably only one RFID reader/writer.

In accordance with the disclosure, there is a printer housing, a print head on the printer housing, the print head being capable of printing on a web of RFID transponder-containing record members movable along a path of web travel, an internal RFID antenna capable of communicating with transponders on the web, a set of at least two selectable RFID scanners any one of which is capable of being coupled to the printer housing, one of the RFID scanners including an external antenna and an external RFID reader/writer capable of reading and/or writing to UHF transponders external to the printer housing, another one of the RFID scanners including an external antenna and an external RFID reader/writer capable of reading and/or writing to HF transponders external to the printer housing, and the internal antenna being capable of being coupled to the RFID reader/writer on the selected RFID scanner.

In accordance with the disclosure, there is a printer including a print head capable of printing on a web of RFID transponder-containing record members movable along a path of web travel, an internal RFID antenna capable of communicating by radio frequency with transponders on the web, and an RFID scanner external to the printer having an external antenna and an external RFID reader/writer coupled to the external antenna, and the RFID scanner being coupled to the internal antenna. The external RFID reader/writer can be coupled to the internal antenna. The RFID scanner can be attached to the printer.

In accordance with the disclosure, there is a method of converting a hand-held portable printer into a hand-held portable printer with an RFID scanner which can comprise providing a hand-held portable printer having a hand-held portable housing with a handle and a print head capable of printing on a web of labels, providing a scanner having an RFID antenna for an RFID reader/writer capable of reading and/or writing to RFID transponders outside the printer, and releasably attaching the scanner housing to the handle.

In accordance with the disclosure, there is a method of converting a printer into an RFID printer capable of RFID reading and/or writing to a transponder outside the printer, comprising providing a printer having an internal RFID antenna capable of RFID communication with transponders on the web, providing an external RFID scanner having an external antenna and an external RFID reader/writer, and releasably coupling the RFID scanner to the internal antenna. The printer may be a portable printer.

In accordance with the disclosure, there is a method of converting a printer with an RFID antenna for reading and/or writing to a web of RFID transponder-containing record members into an RFID printer capable of RFID reading and/or writing to a transponder outside the printer, comprising providing a printer having an internal RFID antenna capable of RFID communication with transponders on the web, providing an external RFID scanner having an external antenna and an RFID reader/writer, and releasably attaching the RFID scanner to the printer including coupling the RFID scanner to the internal antenna. The printer may be a portable printer.

BRIEF DESCRIPTION OF THE DIAGRAMMATIC DRAWINGS

DETAILED DESCRIPTION OF THE PREFERRED EMBODIMENTS

Figure 1:
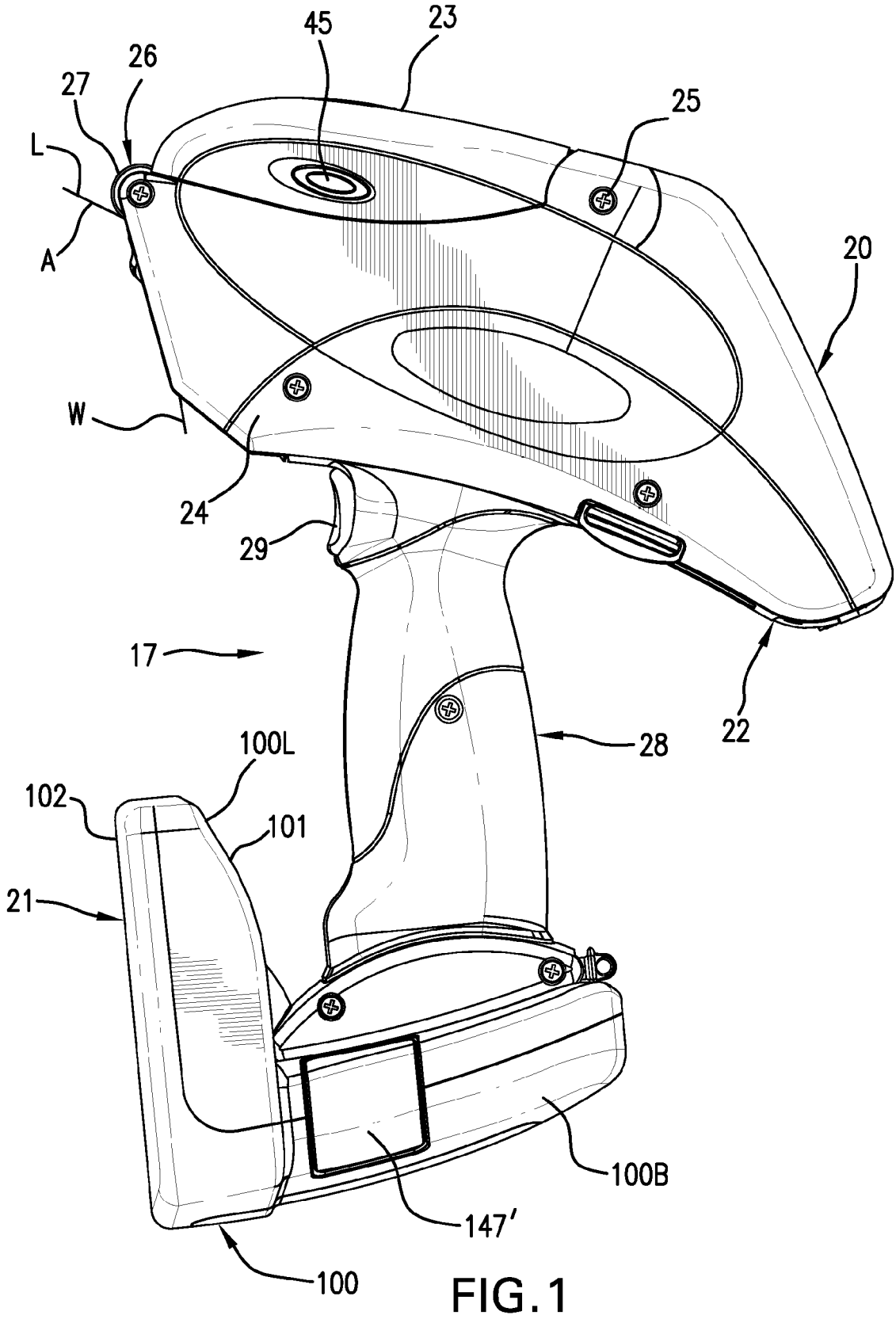
FIG. 1 is a side elevational view of a system including an RFID printer with an RFID scanner in accordance with the disclosure.

With reference to FIG. 1, there is shown a printing system generally indicated at 17. The system 17 includes a printer generally indicated at 20 and an RFID scanner or scanner attachment generally indicated at 21 connected to the printer 20. The printer 20 is shown to include a printer housing or frame generally indicated at 22 having a housing section or frame section 23 and a housing section or frame section 24 movable relative to each other. The housing section 23 can pivot about a pivot 25 between a closed, operating portion shown in FIG. 1 for example and an open or loading or non-operating position shown in FIG. 4. The housing section 24 mounts an applicator generally indicated at 26 preferably in the form of an applicator roll 27. FIG. 1 shows a label L as having been dispensed into label applying relationship beneath the applicator 26 and a carrier web W as exiting the printer 20. The label L has a pressure sensitive adhesive coating A adhered to its underside. The housing section 24 of the housing 22 is shown to have a manually engageable, downwardly extending handle 28. A trigger switch 29 disposed at the handle 28 is depressible to operate the printer 20. The trigger switch 29 is disposed at the upper portion of the handle 28 in easy reach by the user's index finger.

Figure 2:
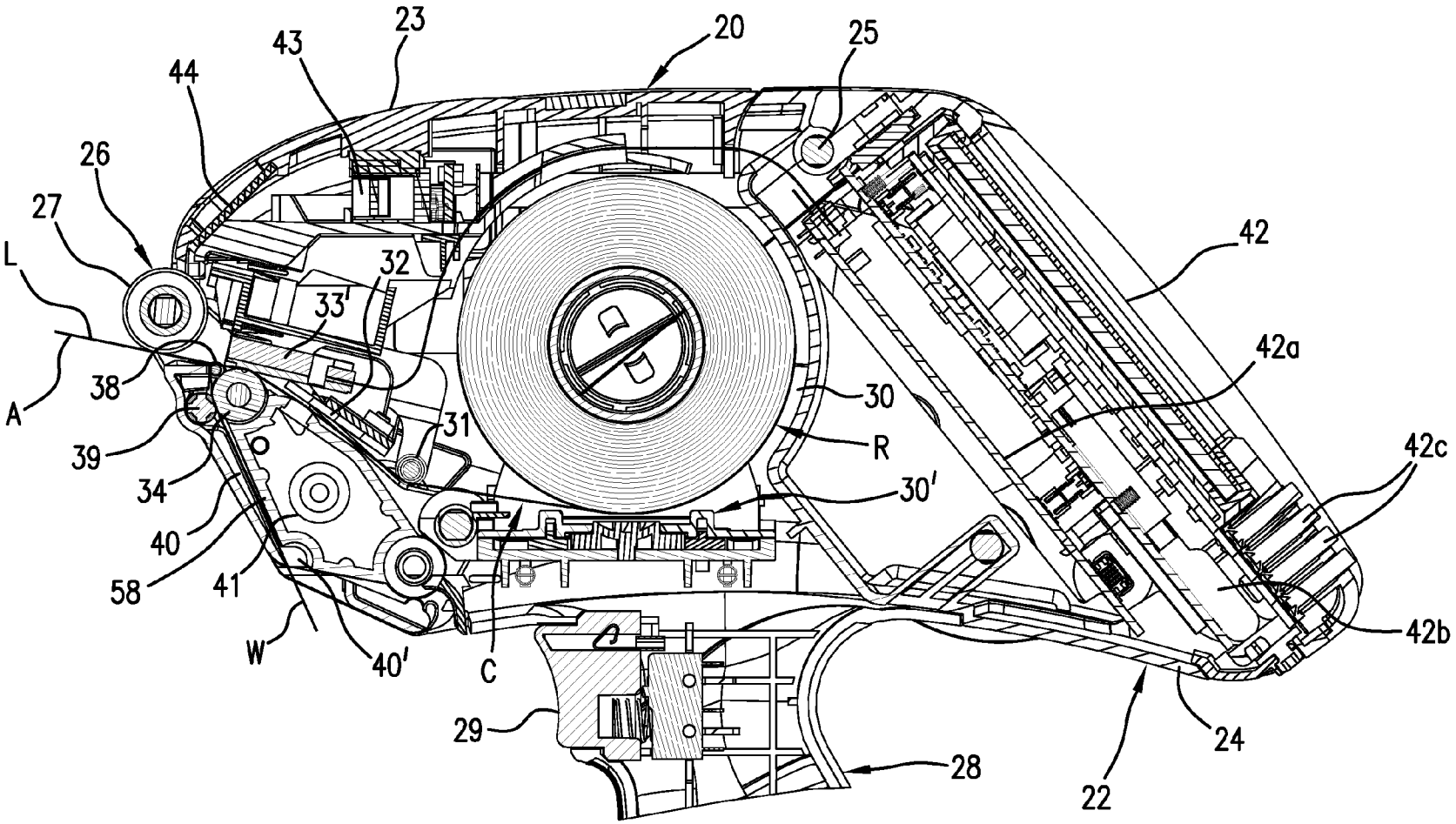
FIG. 2 is a fragmentary sectional view in one vertical plane through the printer.

As viewed in FIG. 2, the housing 22 has interior space 30 for mounting a roll R of record members such as tags, labels or receipt paper. The illustrated record members of a composite label web C can be comprised of the carrier web W and thermally-coated labels L adhered along the length of the web W to a release coating on the carrier web W. The roll R can be conveniently mounted center-justified by a roll mounting assembly 30' which can be like the roll mounting assembly shown in U.S. Pat. No. 5,486,259. The composite web C is paid out of the roll R and can be guided along a path of web travel, for example by passing under and in guided contact with a guide roll 31. The composite web C can pass along the path of travel preferably beneath an RFID antenna 32 as best shown in FIG. 6 and from there the composite web C passes between a print head 33 and a platen roll 34. The print head 33 can include heating or printing elements 35 mounted on a substrate 36 (FIGS. 4 through 6) preferably in a linear array. The substrate 36 can be adhesively adhered to a heat sink 37 which absorbs excess heat created when at least some of the heating elements 35 are turned "on". The heating elements 35 can print on successive labels L while the composite label web C is being fed. As the carrier web W passes partially around a delaminator 38 (FIGS. 2 and 3), labels L are successively delaminated from the carrier web W, and the delaminated label L passes into label applying relationship beneath the applicator 26. The spent carrier web W passes partially around the platen roll 34 and then into the nip between the platen roll 34 and a freely rotatable pressure roll 39. From there the spent carrier web W passes through an exit chute 40 and out through an exit opening 40'. Further details of the preferred structural embodiments for loading and guiding the carrier web W to the outside of the printer 20 are disclosed in U.S. patent applications Ser. Nos. 11/801,281 and 11/998,757. The platen roll 34 is preferably a driven roll and is most preferably the only driven roll to advance the carrier web W. The platen roll 34 thus can be considered to be a feed roll to advance the composite web C and its carrier web W. The platen roll or feed roll 34 is coupled to and is driven by an electric motor 41 through gearing (not shown) such as disclosed in U.S. Pat. No. 5,486,259.

The printer 20 can also include a touch screen 42 and a keypad or keys 42*c* to manually enter data to be printed. A controller 42*a* and a radio card 42*b* are also provided as in U.S. patent application Ser. No. 11/383,363. The housing section 23, which may be termed the upper housing section or the first housing section, can mount a bar code scanner 43 aligned with a window 44 to input, for example, barcode data. The scanner 43 can be a bar code scanner such as a laser scanner or a CCD scanner, if desired. In turn, the housing section 24 may be termed the lower housing section or the second housing section.

Figure 3:
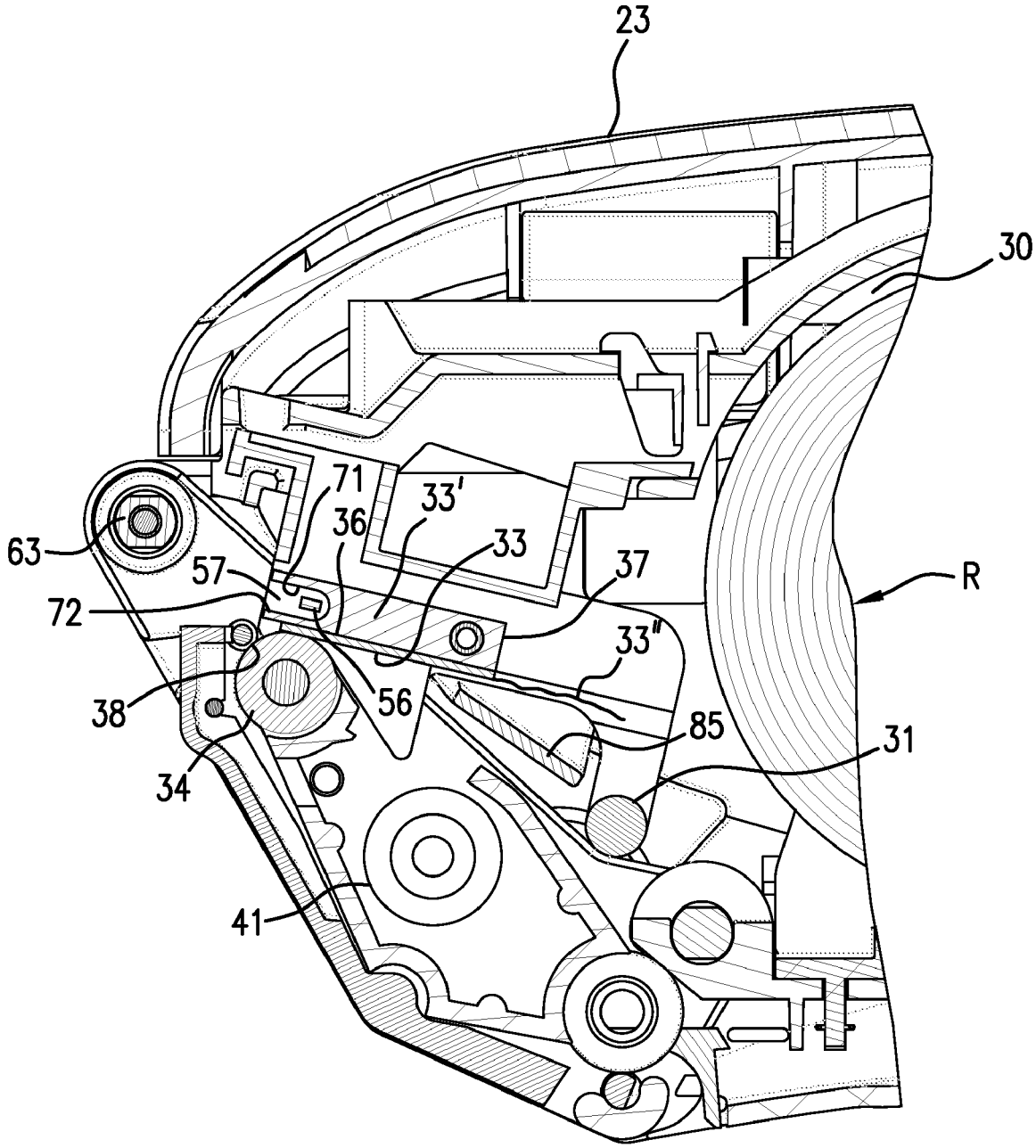
FIG. 3 is an enlarged, fragmentary sectional view of a front portion of the printer in a different vertical plane from the vertical plane of FIG. 2, wherein certain components are omitted for clarity.
Figure 4:
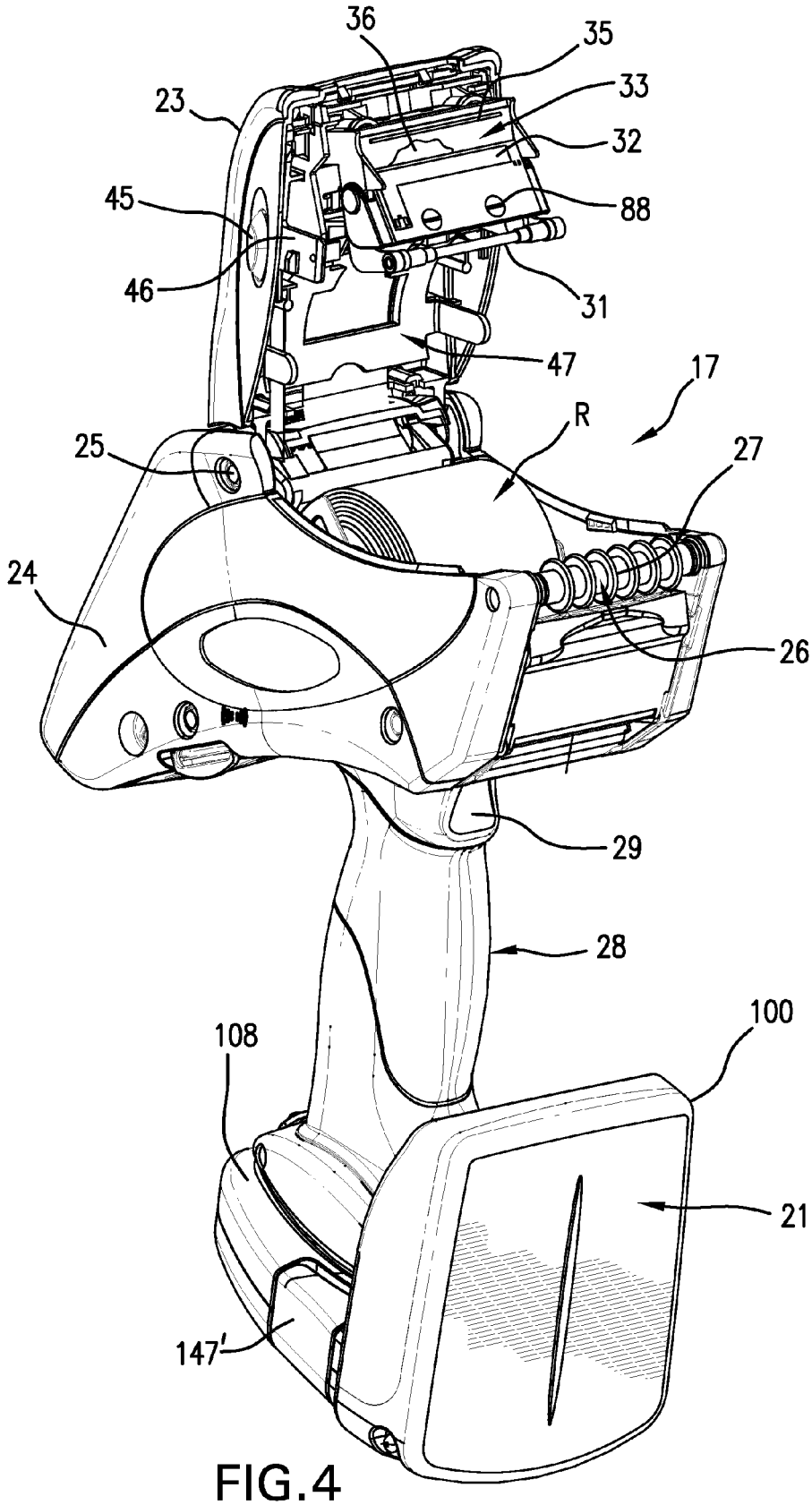
FIG. 4 is a pictorial view of the printer and the RFID scanner, with an upper housing section shown in the open position relative to a lower housing section.
Figure 5:
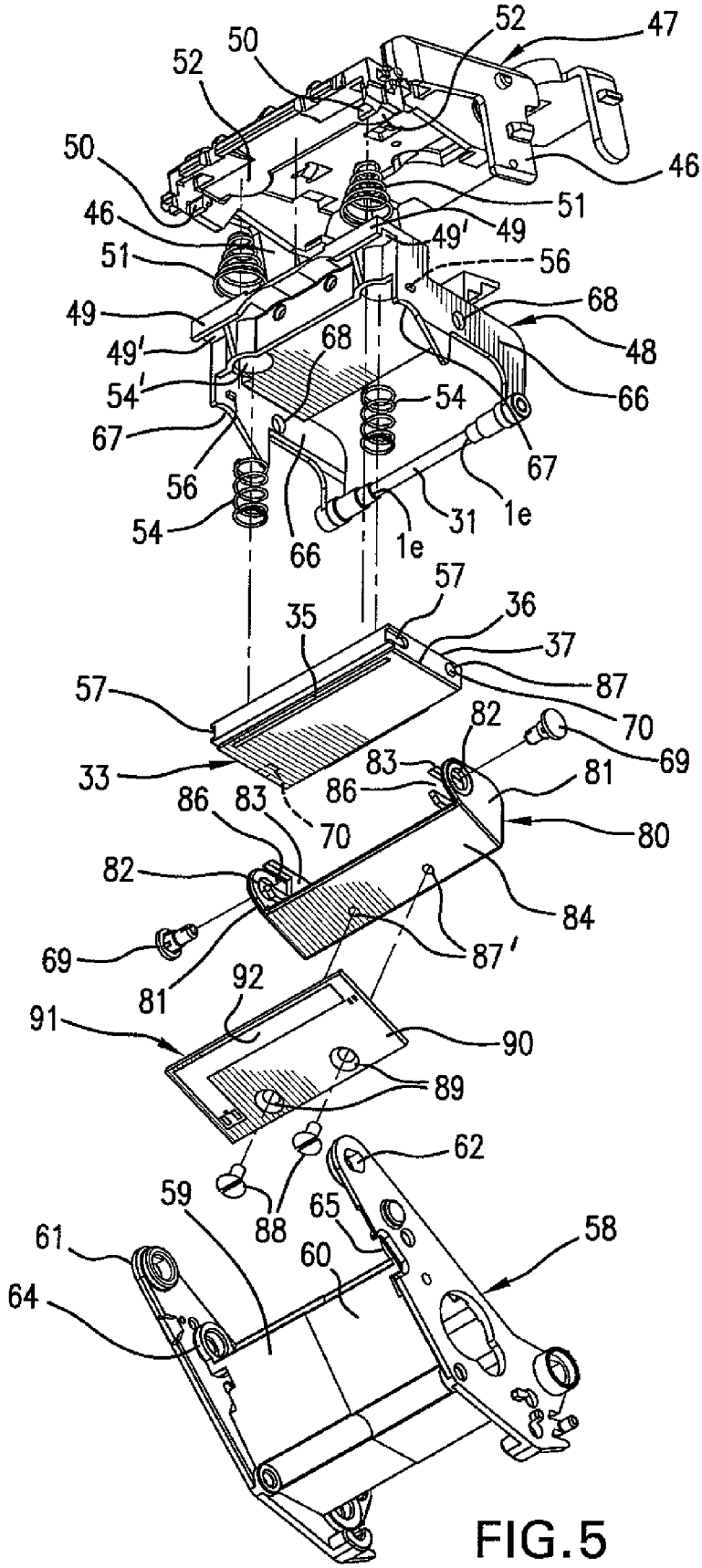
FIG. 5 is an exploded, fragmentary pictorial view of certain components of the printer.
Figure 6:
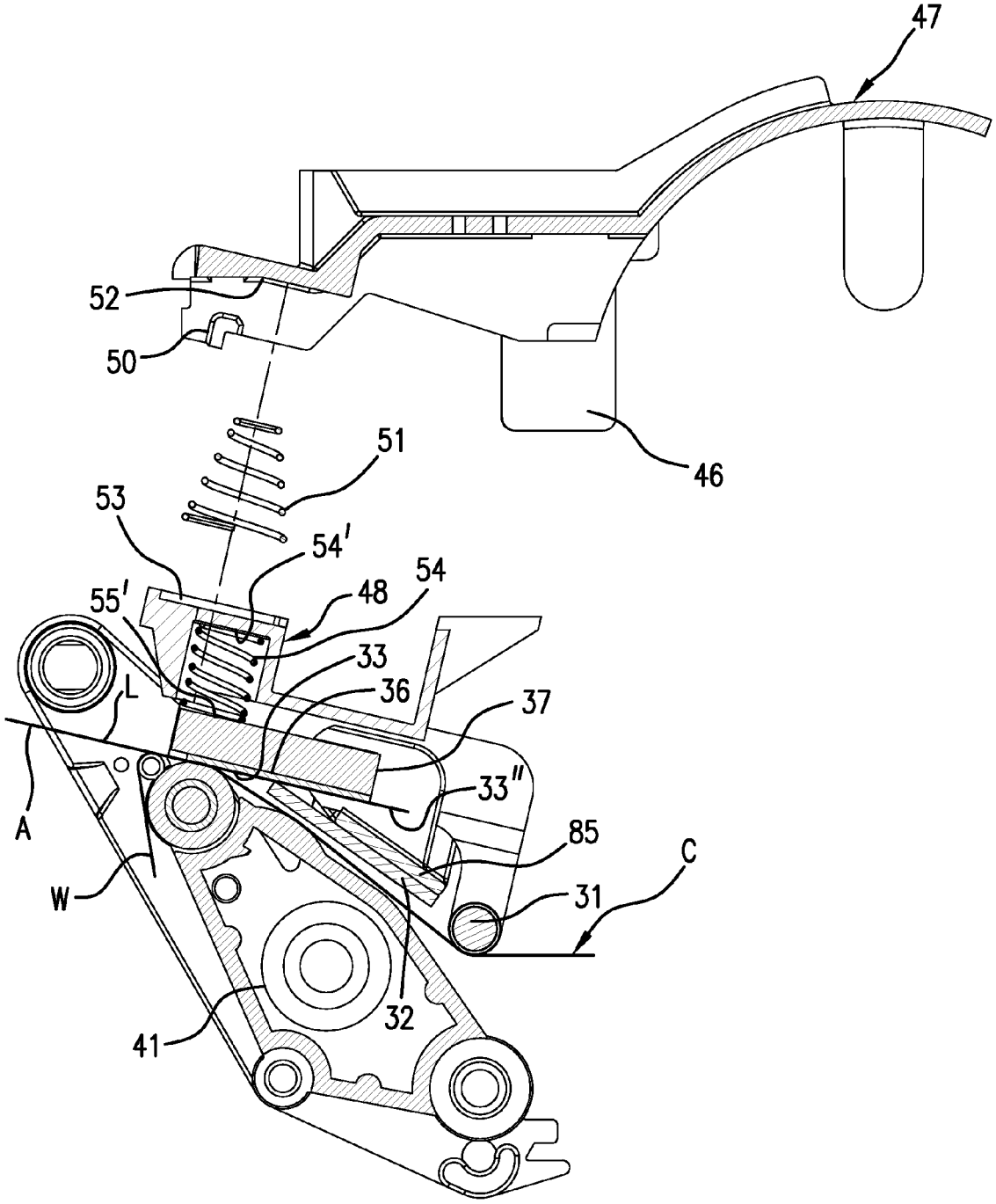
FIG. 6 is an exploded, partly sectional side elevational view of certain components of the printer.

Latch buttons 45 can operate latches 46 (FIGS. 4 and 5). The latches 46 releasably hold the housing section 23 latched to the housing section 24 in the FIG. 1 position. In the FIG. 4 position, the housing section 23 has been moved, that is pivoted, to the open, non-operating, loading position about the pivot 25 in which the print head 33 is separated from the platen roll 34 (FIGS. 2 and 3). Thus, in the open position of the housing section 23 relative to position of the housing section 24, a label roll R or other suitable record medium such as a roll of thermally coated labels or receipt paper, can be inserted into the space 30 (FIGS. 2 and 3).

Figure 7:
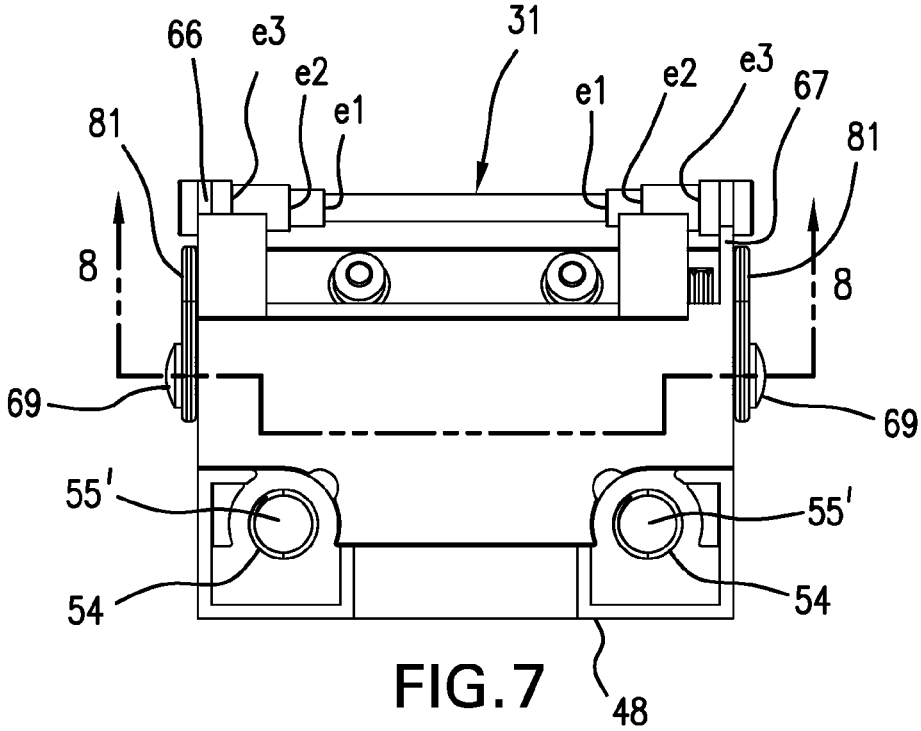
FIG. 7 is top plan view showing holders.

With reference to FIG. 5, it is seen that the latches 46 form a part of a bracket 47 that is securely but releasably connected to the inside of the housing section 23 (FIG. 2). A holder 48 which carriers the guide roller 31 is mounted to the bracket 47 for limited movement. The holder 48 has a pair of L-shaped flanges 49. The flanges 49 capture posts or studs 50 on the bracket 47. A pair of compression springs 51 bears against spaced surfaces 52 on the bracket 47 and against spaced surfaces 53 (one of which is shown in FIG. 6) of the holder 48 to urge the L-shaped flanges 49 against the posts 50. A pair of compression springs 54 bears against surfaces 54' on the holder 48 and an upper flat surface 55' of a heat sink 55 (FIG. 7). The heat sink 37 is preferably comprised of a block of thermally conductive material such as aluminum which can conduct excess heat away from the print head 33. Although a pair of springs 51 is preferred, a single centrally located spring could be used instead. Likewise, although a pair of springs 54 is preferred, a single centrally located spring could be used instead.

As shown in FIGS. 3 and 6, the print head 33 is illustrated by a heavy line and the substrate 36 is shown by sectioning. The print head 33 is connected to a ribbon conductor 33" and to the printer's electronics.

The holder 48 has a pair of oppositely facing studs 56 (FIG. 5) received in identically-shaped grooves 57 in opposite sides of the heat sink 37. The grooves 57 are wider from top to bottom than the height of the studs 56 so that the heat sink 37 can move relative to the holder 48 against the bias of the springs 54. The top of the groove 57 is designated 71 and the bottom of the groove 57 is designated 72 (FIG. 3). A subframe generally indicated at 58 (FIG. 5) can include two mirror-image sections 59 and 60 attached to each other. The subframe 58 is securely mounted in the housing section 24 (FIG. 2). Axially aligned portions 61 and 62 mount rotatably mount the applicator roll 27 on a shaft 63 (FIG. 3). The sections 59 and 60 also have respective, oppositely facing, mirror image stops 64 and 65. The holder 48 has parallel members 66 that have various features. The members 66 mount the studs 56. The members 66 have curved stop surfaces 67. The members 66 also have aligned holes 68. The members 66 also mount the roll 31.

The prior art includes the housing section 23, the bracket 47, the holder 48, the springs 51 and 54, the print head assembly 33', the head sink 37, the subframe 58 and the guide roller 31 arranged as depicted in FIGS. 1 and 5. In addition, fasteners like fasteners 69 extended through the holes 68 and were received in aligned hole 70 in the heat sink 37. The prior art construction functions as follows: In the open or loading position shown in FIG. 4, the springs 51 urge the holder 48 to a position in which the posts 50 bottom in pockets 49' formed by the L-shaped flanges. In addition, the springs 54 cause the studs 56 to bear against the tops 71 of the grooves 57. As the housing section 23 is being closed and approaches close to the operating position shown in FIGS. 1 through 3, the stop surfaces 67 contact the stops 64 and 65. With continued movement of the housing section 23 toward the operating position, the springs 51 become compressed. Also, as soon as the print head 33 begins to press against the platen roll 34, the springs 54 begin to compress and the studs 56 move out of contact with top or upper edges 71 of the slots 57 and move toward a position spaced between upper and lower edges 71 and 72 of the respective grooves 57 as best shown in FIG. 3. So when the housing section 23 is in the closed or operating position, the print head 33 is properly located with respect to the platen roll 34 and the print head 33 exerts proper printing pressure against the composite label web C and the platen roll 34. The foregoing description of the prior art arrangement is functionally similar to that disclosed for mounting the print head depicted in prior art U.S. Pat. No. 5,486,259.

Figure 8:
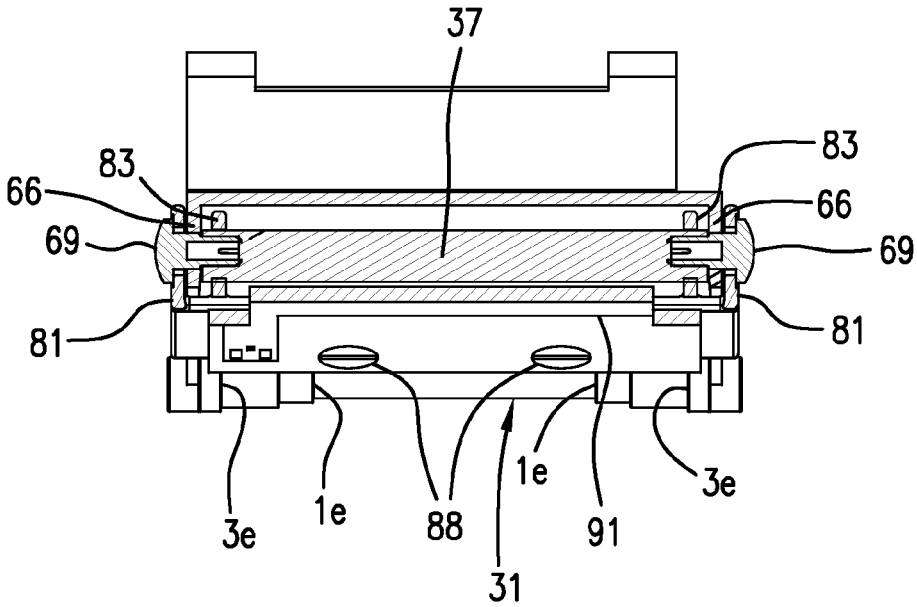
FIG. 8 is a sectional view taken along line 8-8 of FIG. 7.

Certain prior art structure has been adopted in the construction of an RFID printer illustrated in the present application. In particular, a holder generally indicated at 80 (FIG. 5) is shown to have spaced side walls 81 with axially aligned holes 82. Spaced inboard of the walls 81 are another pair of walls 83 secured to the underside of a connecting wall 84. The walls 83 have open-ended slots 86 which capture end portion 87 of the heat sink 37. Each fastener 69 first passes first through the hole 82 in the respective wall 81, then through the hole 68 in the wall 66, then is press-fitted into the hole 70 in the heat sink. It is apparent that the walls 66 fit into the spaces between respective adjacent spaced walls 81 and 83 as best shown in FIG. 8. It is thus apparent that the holder 48 mounts the print head assembly 33' and that the holder 48 also mounts the holder 80, and that the holder 80 preferably also captures and moves as a unit with both the print head assembly 33' and the heat sink 37 as the housing section 23 is being closed. The wall 84 preferably has a pair of spaced holes 87'. Screws 88 pass through holes 89 in a printed circuit board 90 having a near field, Ultra High Frequency (UHF) micros trip antenna 91. The antenna 91 is thus removable and readily replaceable with a new antenna or with an antenna having different characteristics without affecting the print head assembly 33'. Replacement can be achieved by detaching the printed circuit board 90 by loosening the screws 88 and substituting another circuit board. The antenna 91 includes a driven microstrip element 92 on the one face of the printed circuit board 90 and a ground plane (not shown) on the other face of the printed circuit board 90. This type of antenna is disclosed in U.S. patent application Ser. No. 10/873,979. Another type of printed circuit board that can be used is one that mounts a High Frequency (HF) antenna as disclosed in U.S. patent applications Ser. Nos. 11/726,259 and 11/901,128. Alternatively, a whip antenna or any other suitable type of antenna which communicates by radio frequency with the transponders can be used. The antenna 91, for example, is thus secured to the holder 80 and moves as a unit together with the holder 80. Thus, as housing section 23 is pivoted about pivot 25 from the open position (FIG. 4) to the closed position as shown in FIGS. 1 through 3, the print head assembly 33' including the heat sink 37, the holders 48 and 80 and the antenna 91 are brought to their proper positions and inclinations. The antenna 91 is then generally parallel and close to the path of composite label web travel as shown in FIGS. 2 and 6. Thus, the antenna 91 or whichever other near field antenna is used can read and/or write to RFID transponders in the composite label web C. As shown for example in FIG. 5, the roller 31 is stepped to guide composite webs C of different widths. Accordingly, the path of composite web travel varies ever so slightly depending on which of the opposed pair of stepped edges e1, e2 or e3 (FIG. 7) is guiding a composite web C of a particular width. However, this slight variation is insignificant. If desired, a guide roller having a constant diameter, circular cylindrical shape can be used without the ability to guide the edges of the composite web if desired in order to always have the path of composite web travel be exactly the same.

Figure 9:
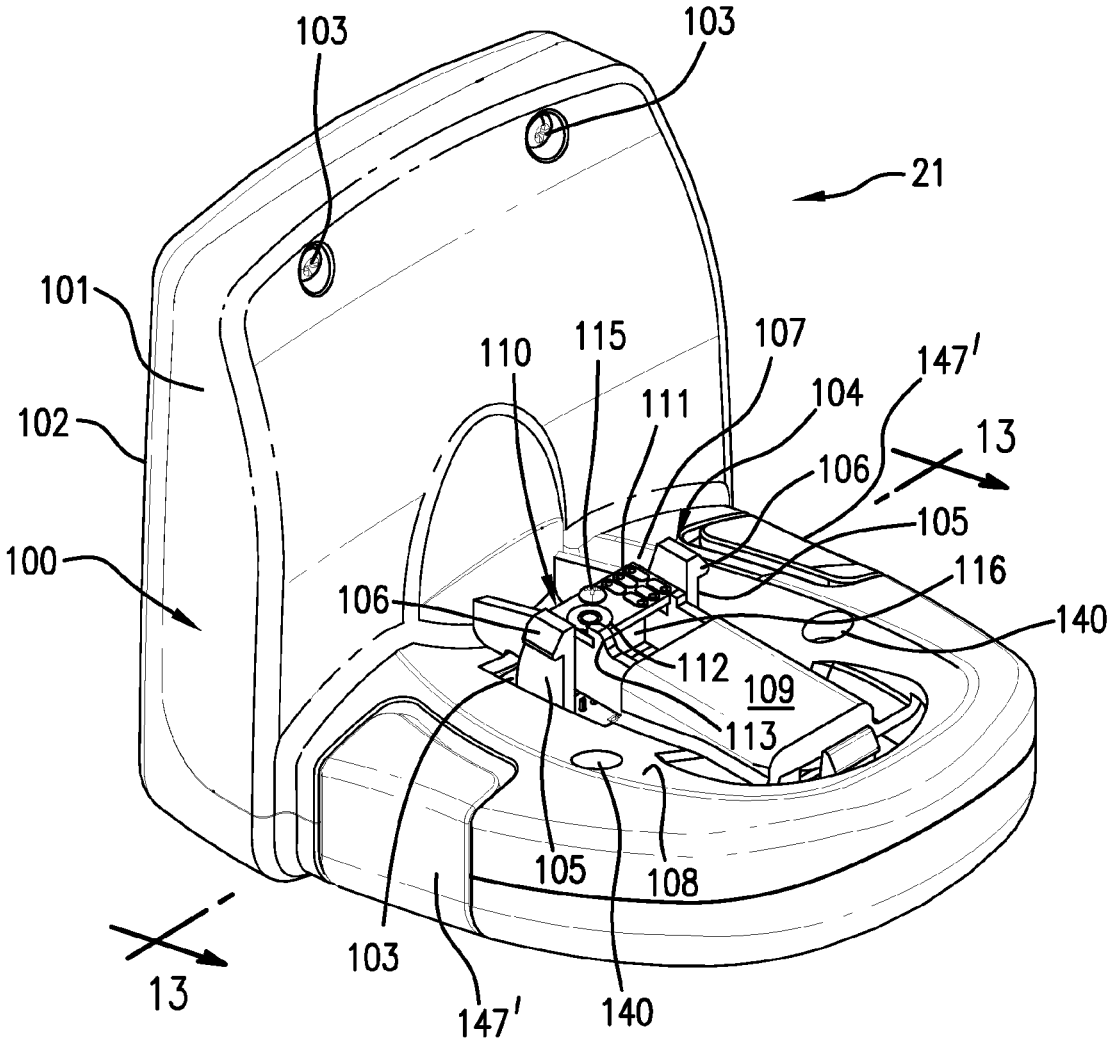
FIG. 9 is a pictorial view of an RFID scanner.

With reference to FIG. 9, there is shown the RFID scanner or scanner attachment which preferably has a generally L-shaped housing 100 which may be referred to as the scanner housing or the attachment housing. The housing 100 can include a pair of generally L-shaped housing sections 101 and 102 releasably secured to each other by various screws 103. A latch generally indicated at 104 is shown to include a pair of jaws 105 with oppositely extending teeth 106 which project upwardly through openings 107. Molded integrally with a top portion 108 of the housing section 101 is a pod or support 109. Adjacent the pod 109 is a printed circuit board 110 which can mount a cluster of six contacts 111 and a pair of annular contacts 112 which constitute a scanner interface SI. The printed circuit board 110 is held in place under a flange 113 and against a stop 114 by a screw 115 threaded into a wall 116 which is molded integrally with the housing section 101.

Figure 10:
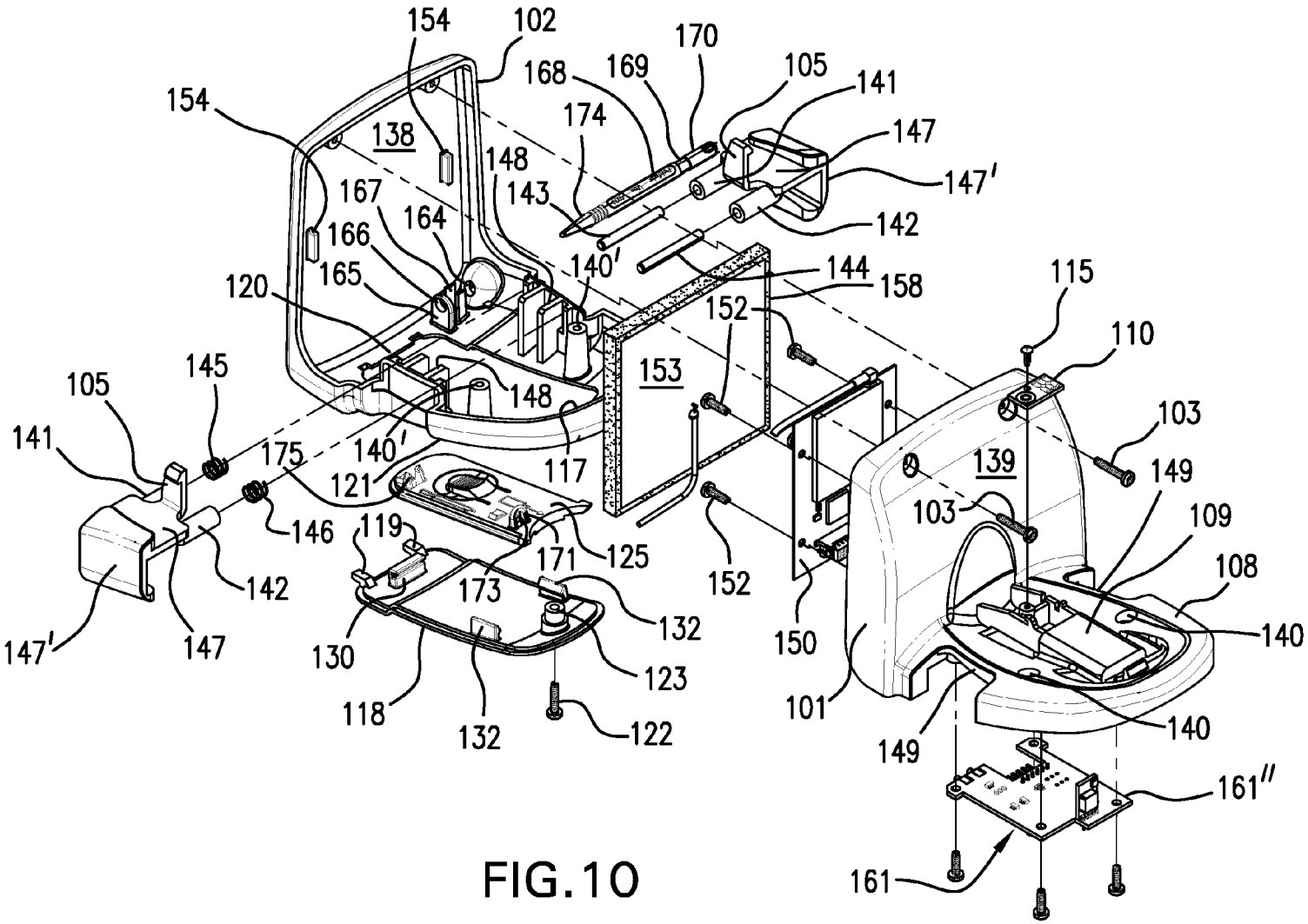
FIG. 10 is an exploded pictorial view of the scanner shown in FIG. 9.
Figure 11:
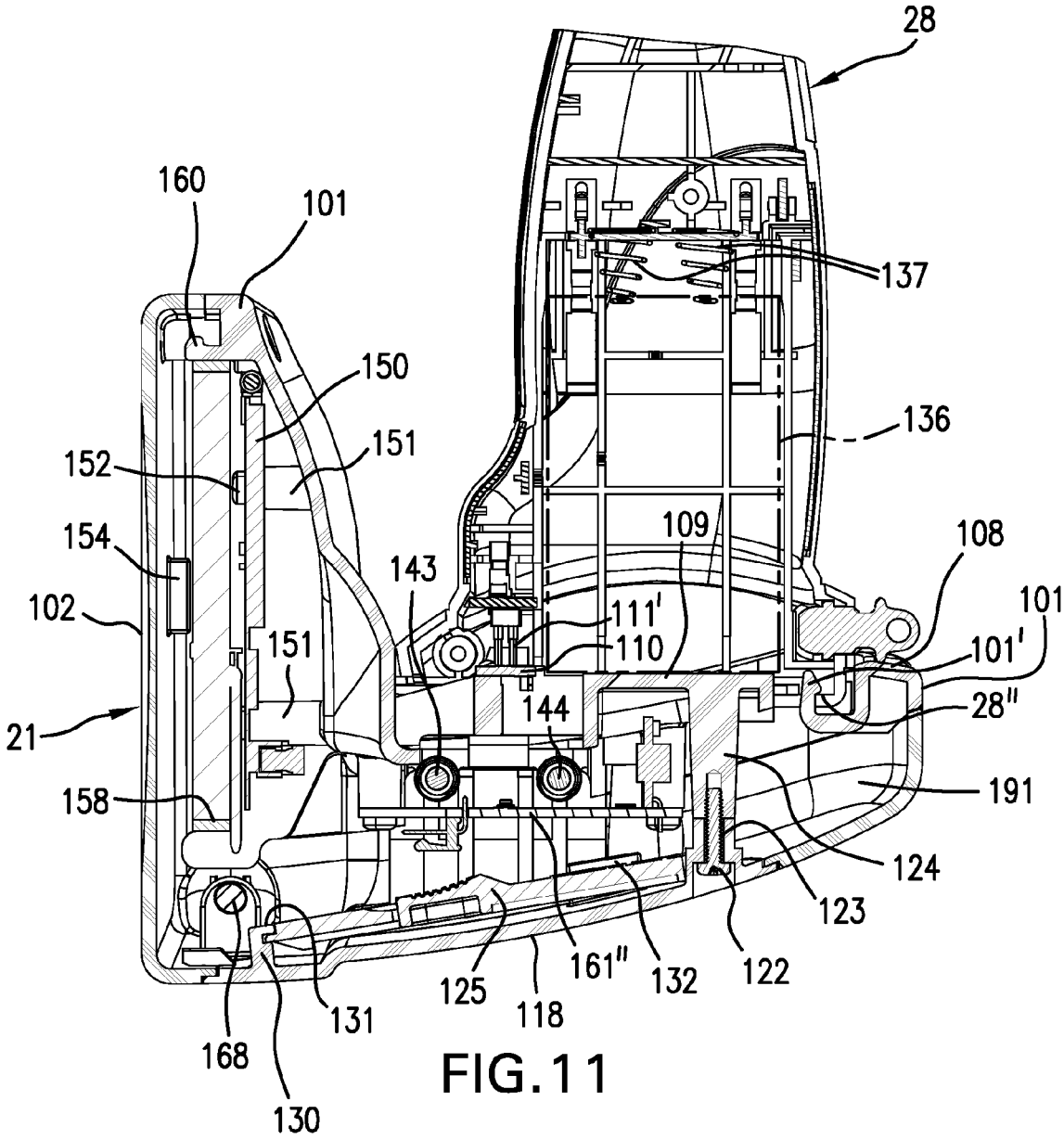
FIG. 11 is a vertical sectional view of the printer handle and the scanner attached to each other.
Figure 12:
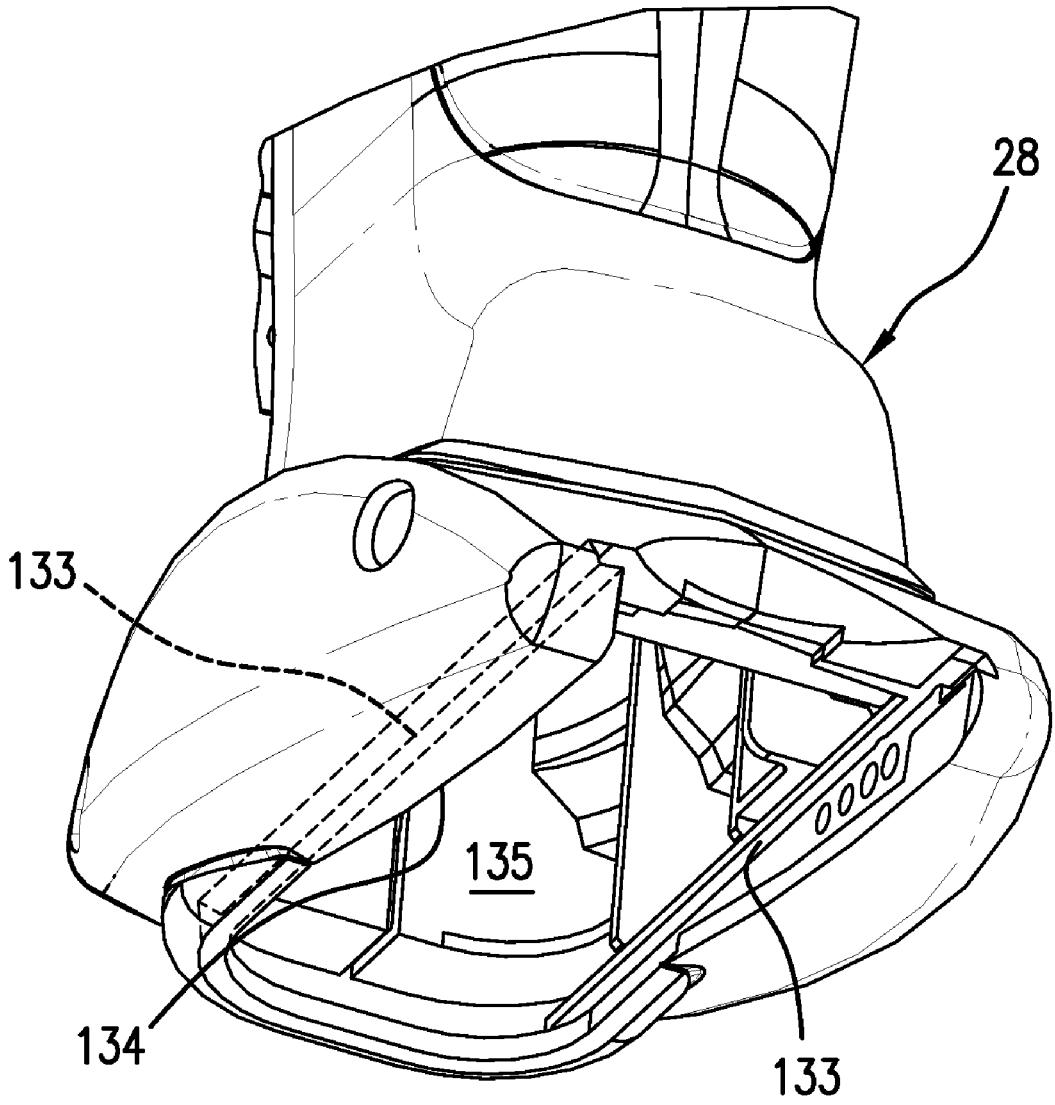
FIG. 12 is a fragmentary pictorial view of the lower end portion of the handle with the door removed.

With reference to FIGS. 10 and 11, the housing section 101 is shown to have an access opening 117 at its underside. A door 118 can cover the opening 117. Integrally molded members 119 on the door 118 extend over inner surface 120 of lower leg or bottom portion 121 of the housing section 102. A screw 122 can pass through a hole 123 and be threadably received in a post 124 formed integrally with the housing section 101 beneath the pod 109. The members 119 and the screw 122 releasably hold the door 118 in place. The door 118 releasably mounts another door or cover 125. The purpose of the door 125 is to close off the open bottom of the handle 28 (FIG. 12) when the attachment 21 is not attached to the printer 20 and thus when the printer 20 is used without the scanner 21. The door 118 includes a support 130 (FIGS. 10 and 11) having a tooth 131 and a pair of toothed spring fingers 132 which releasably hold the door 125 to the door 118. The door 125 is depicted in FIGS. 10 and 11. When the printer 20 is used without the attachment 21, the door 125 is slid into parallel, opposed, mirror image slots 133 (FIG. 12) to close off the bottom opening 134 in the handle 28. Thus, the door 125 closes off a battery compartment 135 and supports one end of the battery 136 shown by a heavy, generally rectangular dot-dash line in FIG. 11. Springs 137 contact and apply a biasing force against the other end of the battery 136. When the door 125 is in place in the grooves 133, the door 125 has been rotated 180 degrees from the position shown in FIGS. 10 and 11 thus, the downwardly facing surface of the door 125 as shown in FIG. 11 becomes the upwardly facing surface that contacts the battery 136 when the door has been slid into position in grooves 133.

With continued reference to FIG. 10, a generally upright position 138 of the section 102 is integrally molded with the bottom portion 121. The housing section 101 has an upstanding portion 139 integrally molded with the top portion 108. When the housing sections 101 and 102 are assembled, the upstanding portions 138 and 139 are secured to each other by the screws 103 and the top portion 108 is secured to the bottom portion 121 by screws (not shown) passing through holes 140 in the top portion 108 and threaded into aligned holes 140' in the bottom portion 121.

With continued reference to FIG. 10, the latches 105 have pairs of aligned tubular members 141 and 142. Each of the aligned tubular portions 141 receives a portion of a pin 143, and each of the aligned tubular portions 142 receives a portion of a pin 144. A compression spring 145 is received about the pin 143 and bears against the tubular portions 141 to bias the clamping jaws 105 apart. Likewise, a compression spring 146 is received about the pin 144 and bears against the tubular portions 142 to bias the clamping jaws 105 apart. Each of the clamping jaws 105 has a guided portion 147 situated between an upwardly facing U-shaped surface or ledge 148 on the bottom portion 121 and a downwardly extending flange 149 on the top portion 108. Thus, the flanges 149 and the surfaces 148 slidably guide the guided portion 147 of the jaws 105 transversely of the housing 100 (FIG. 9). With reference to FIGS. 10 and 11, the housing section 101 has an integrally molded hook 101' which can hook onto a surface 28" on the handle. Thus, the scanner housing 100 is held to the handle 28 by both the hook 101' and the jaws 105.

Figure 15:
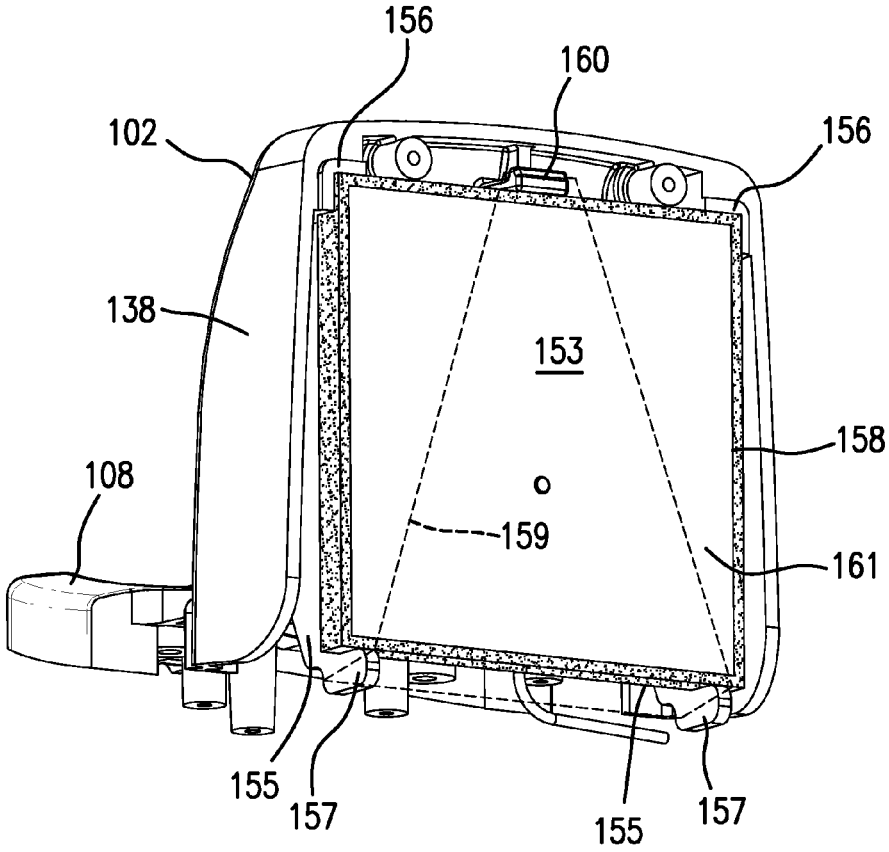
FIG. 15 is a pictorial view of another housing section of the scanner attachment used with the housing section shown in FIG. 14.
Figure 16:
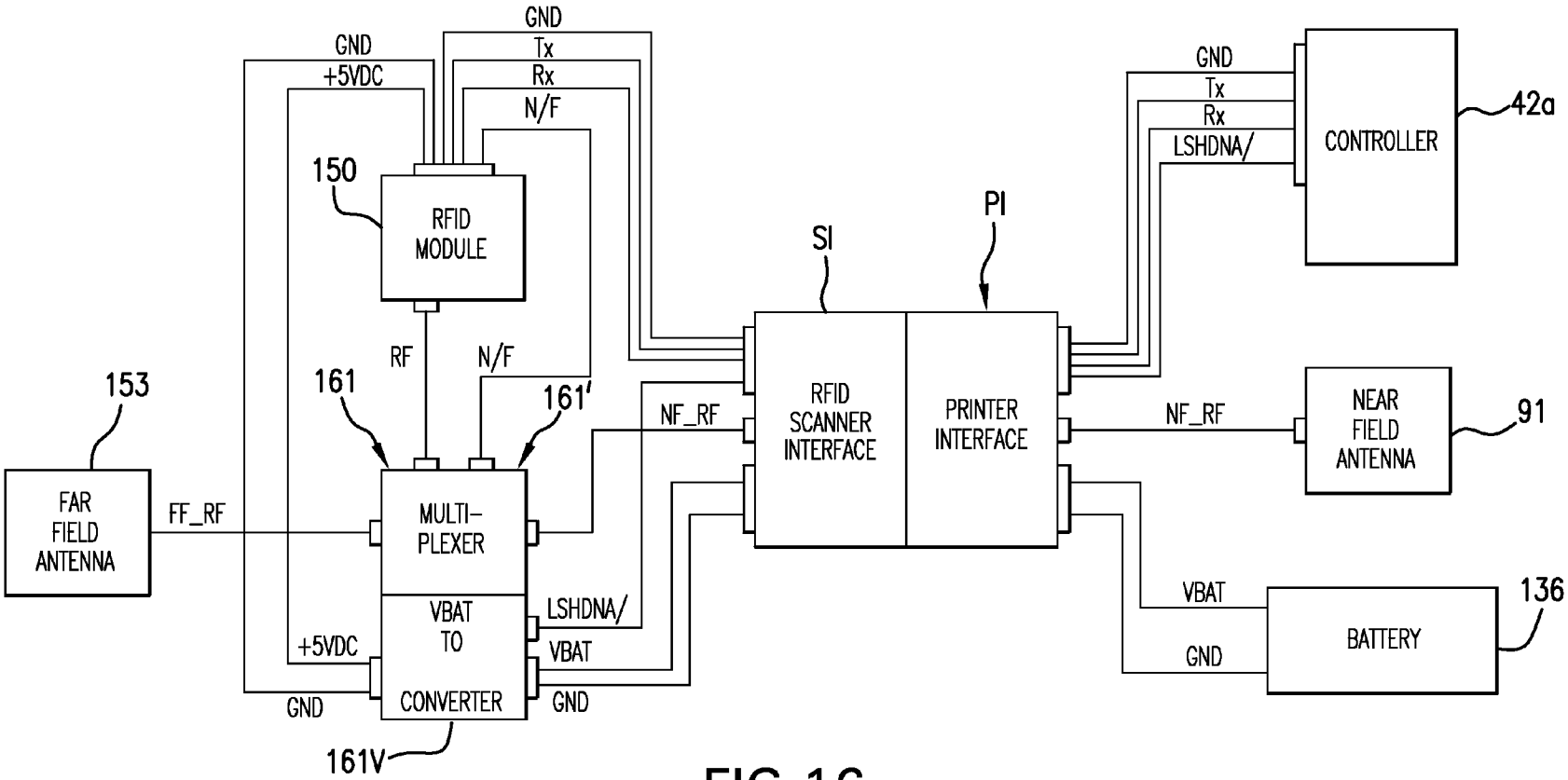
FIG. 16 is a diagram showing the coupling of the antennas to an RFID reader/writer and the controller.

With reference to FIGS. 10 and 11, an RFID reader/writer module 150 is mounted to standoffs 151 on the inside of the housing section 101 and secured in place by screws 152. A far field antenna 153 is disposed against standoffs 154 on the upstanding position 138 and rib-like standoffs 155 (FIG. 15).

In addition, the antenna 153 is supported at its upper corners by angle-shaped members 156 and by flanges 157 integral with the standoffs 155. The antenna 153 can have a rigid exterior and is shown to have a thin rectangular shape. A cushion 158 is shown to pass around the outer periphery of the antenna 153 and is in contact with the members 156 and the flanges 157. The cushion 158 can be comprised, for example, of electrical tape. A band 159 shown by dash lines for clarity to pass about an L-shaped flange 160, over a front face 161 of the antenna 153 and behind and around the flanges 157. The band 159 can be a rubber band or it can be of any other elastic or inelastic material that does not interfere with the input or output signals to or from the antenna 153.

The antenna 153 can for example be either an ultra high frequency (UHF) type of antenna as shown, or a high frequency (HF) type of antenna, or other type.

A multiplexer 161 is shown to comprise a switch 161' formed on a printed circuit board 161". The printed circuit board 161' also contains a voltage regulator 161V. The multiplexer 161 (FIGS. 10, 11, 13 and 16) can be connected to contacts 111 and 112 (FIG. 9) of the printed circuit board 110, the battery 136, the reader/writer 150, the antenna 153 and lines to and from a controller 42*a*. The printed circuit board 161" is mounted to bosses 162 on the underside of the top portion 108 by screws 163.

Figure 13:
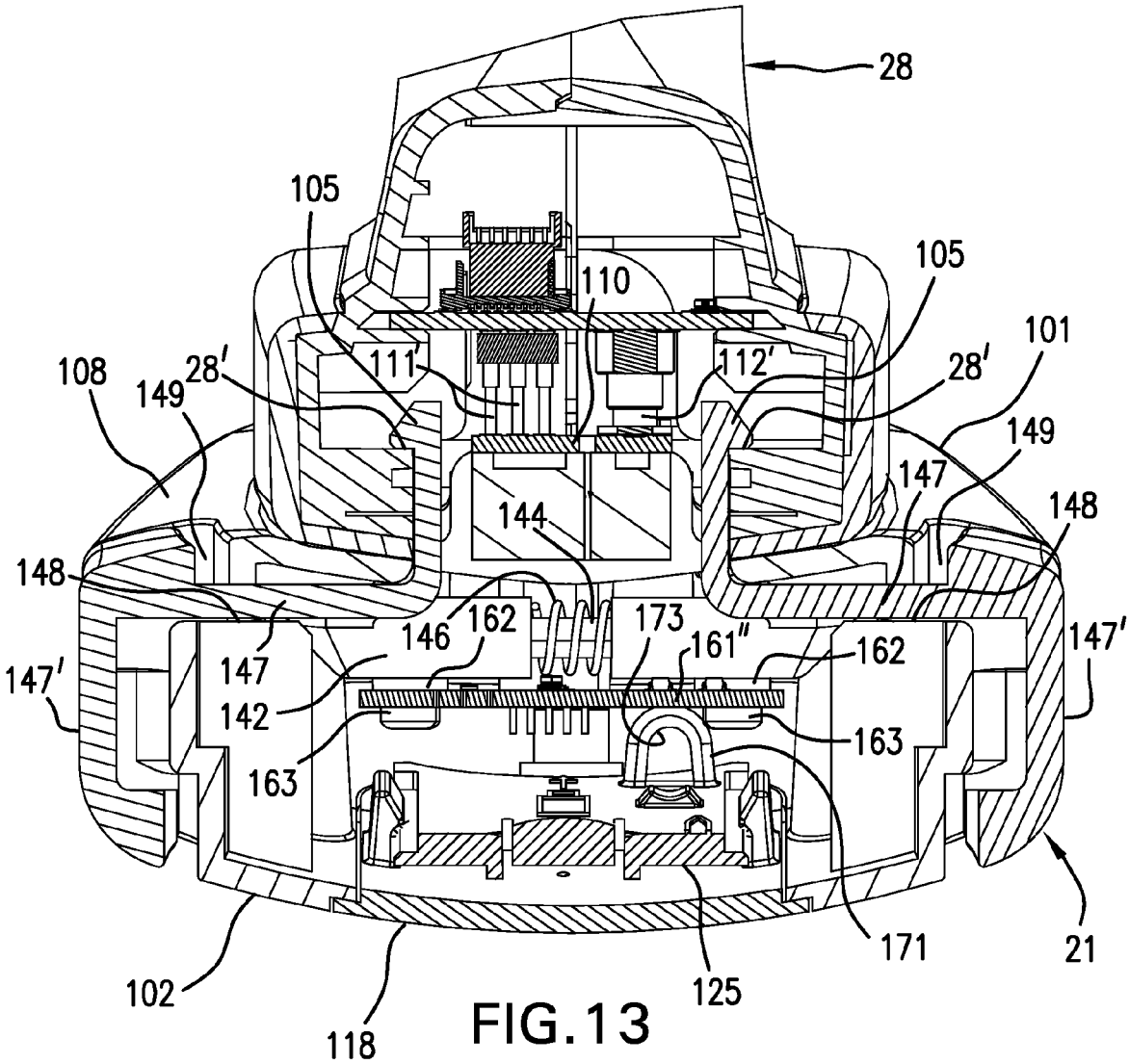
FIG. 13 is a sectional view taken generally along 13-13 of FIG. 9.
Figure 14:
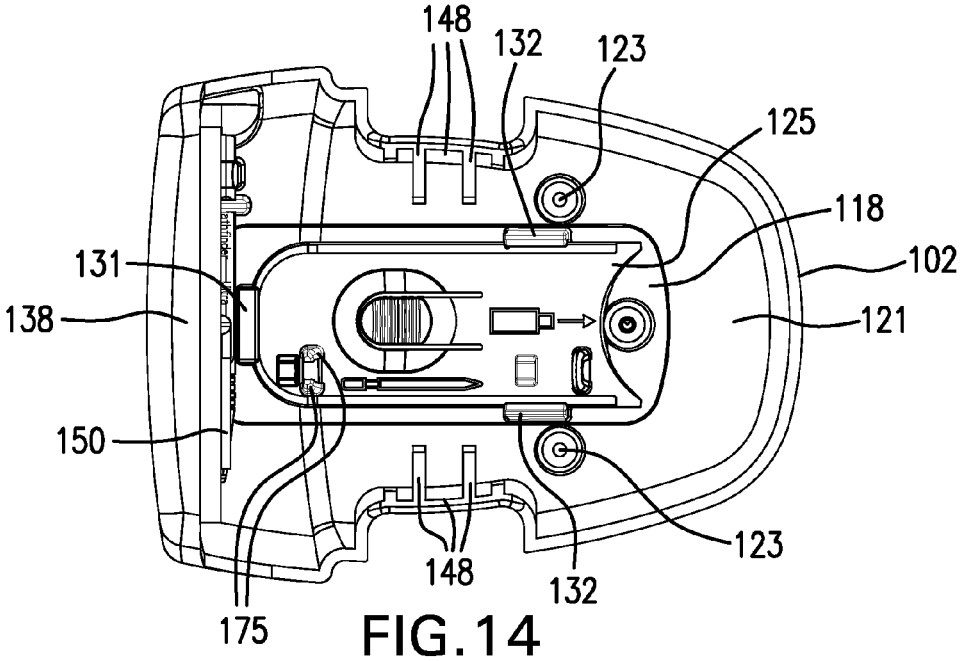
FIG. 14 is a top plan view of one housing section of the scanner attachment.

With reference to FIG. 10, the housing section 138 has an opening 164. An upstanding member 165 on the inside of the section 102 has a hole 166. A pair cantilevered fingers 167 is disposed between holes 164 and 166. The holes 164 and 166 and the space between the spring fingers 167 are aligned along an axis. A stylus 168 can be inserted partially into the housing section 102 through the holes 164 and 166 and into the space between the spring fingers 167 in order to store the stylus 168. The purpose of the stylus 168 is to operate the touch screen. The spring fingers 167 engage the stylus 168 at a groove 169 to hold the stylus releasably captive in the scanner housing 100. When the stylus 168 is held with the spring fingers engaged in the groove 169, the manually engageable head 170 of the stylus 168 projects outside the housing 100 to enable the stylus 168 to be grasped and removed. As the stylus 168 is withdrawn from the housing 100, the spring fingers 167 move apart slightly to enable the withdrawal. The stylus 168 can be stored on the door 125 as best shown in FIGS. 10, 13 and 14. The door 125 has a member 171 with a through-opening or hole 173 that can receive pointed end portion 174 of the stylus 168. When the end portion 174 is captive in the opening 173, the groove 169 is between toothed spring fingers 175 between which the stylus 168 is releasably held in place.

The electronics and programs and the method of operation and use of the system 17 (FIG. 1) can be the same as in U.S. patent application Ser. No. 11/383,363 and in particular its block diagram of FIG. 7 and the flow diagrams of FIGS. 10 through 16, 16-1, and 17 through 29 and descriptions relating thereto, which have been incorporated by reference. However, the diagram of FIG. 16 of the present application is specific to the present disclosure. Therefore, in reference to the disclosure of the present FIG. 16, there is disclosed the printer interface PI and the RFID scanner interface SI which are preferably detachable from each other. The printer interface PI is connected to the printer's controller 42*a*, the antenna 91 and the battery 136. The RFID scanner interface SI can be connected to the RFID reader/writer or module 150, to the multiplexer 161 and to the voltage regulator 161V. The antenna 153 can be connected directly to the multiplexer 161. The antenna 91 can be connected directly to the multiplexer 161 through the interfaces PI and SI. The voltage regulator 161V keeps the battery voltage relatively constant at the illustrative +5 volts. It is apparent that the RFID reader/writer 150 is common to both antennas 91 and 153. While the reader/writer 150 is preferably located in the scanner 21 it could be located in the printer 20.

While it is preferred to attach the scanner 21 to the printer, if desired, the RFID scanner 21 can be separate and spaced from the printer 20 electrically via a cable. This is another way this RFID-enabled printer can be made to be a printer that can RFID encode transponders on the web C in addition to reading from and/or writing to transponders external to the printer.

The printer 20 can be used as an RFID printer in the manner of the printer disclosed in U.S. patent application Ser. No. 11/383,363 to print on record members such as labels and to RFID encode such record members.

The use of the RFID scanner attachment 21 enables the printer 20 of the present application to be selectively upgraded or converted or retrofitted to be an RFID printer. Therefore, the printer 20 with its internal antenna 91 may be referred to as an "RFID-enabled printer". It is when the external scanner 21 with its external antenna 153 and its external RFID reader/writer 150 are coupled to the printer that the printer 20 becomes capable of RFID encoding RFID transponders on the web C. In addition, the printer 20 can receive RFID data from transponders external to the printer 20 and to write to RFID transponders external to the printer 20. In ordinary use of the printer 20 without the scanner 21, the door 125 is in position at the bottom of the handle 28 and the battery 136 bears against the door 125. The printer 20 can receive RFID and printable data from external sources by radio and/or data can be entered via the touch screen 42 and/or a wired connection. If and when it is desired to add external RFID input or output of RFID data to the printer 20, the scanner 21 can be releasably attached or connected to the printer 20 as shown in FIGS. 1, 4, 11 and 13. To attach the scanner attachment 21, the finger-engageable buttons 147' are squeezed together to bring the jaws 105 toward each other against the biasing of the springs 145 and 146. The jaws 105 can thus clear the shoulders 28' on the handle 28. When the jaws 105 are inserted into the space within the handle 28 to a position on which teeth 105' of the jaws 105 are at or above the shoulders 28', the buttons 147' can be released so that the springs 145 and 146 can move the jaws 105 apart to the latched position shown in FIG. 13. In the latched position one series of six pins 111' contacts the six contacts 111 (FIG. 9) and another series of two pins (not shown in FIG. 9) constitute a printer interface PI and make contact with the respective contacts 111 and 112; these pins are preferably spring-loaded so that they make contact with the respective contacts 111 and 112 reliably. When the attachment 21 is latched in the position shown in FIG. 11, the battery 136 is in contact with and is supported on and by the pod 109 as the attachment 21. When thus connected, the scanner attachment 21 is capable of reading and/or writing to external transponders and the printer 20 is capable of printing data received from the attachment 21 and RFID encoding transponders internal to the printer housing 22. To again convert the system 19 to a printer 20 without input from the RFID scanner 21, the user depresses or squeezes the buttons 147' simultaneously to unlatch the scanner attachment 21. Thereupon, the door 125 can be slid onto the handle 28. It is noted the attachment 21 can preferably be connected to and disconnected from the printer 20 without the use of any tool.

By disposing the scanner attachment 21 spaced from the applicator 26 and even spaced from the exit opening 40' (FIGS. 1 and 2), there is no interference by the scanner attachment 21 with the printing and dispensing function. In particular, the upper end of the scanner attachment housing 100 is spaced downwardly from the portion of the printer housing 100 that is disposed above the handle 28. The upstanding leg 100L of the housing 100 is disposed forward of the handle 28 and the bottom leg 100B underlies the handle 28. So the scanner attachment 21 is out of the way for labeling items, and yet the applicator 26 and the leg 100L provide a convenient way to support the system 17 on a table or the like when not in use.

If it is desired that the scanner 21 be powered by a battery in the scanner housing 100, one can be provided in space 191 (FIG. 11). In that way, no electrical energy is taken from the main battery 136 during use.

The expressions "coupled" and "coupling" as used herein is not limited to physical or direct attachment of a scanner attachment to the printer housing but can include electrical or cord connection of a remote scanner spaced from the printer.

By way of example, not limitation, the multiplexer 161 can be a commercially available transmit receive switch marketed under the Model No. HMC226/226E GaAs MMIC +3V SOT26 TRANSMIT/RECEIVE SWITCH DC-2.0$GH_3$ by Hittite Microwave Corporation, Chelmsford, Mass. The RFID reader/writer or module can be a model No. M9-MH of SkyeTek, Inc., Westminster, Colo. The antenna 153 can be a Model AT900-4W-MMCXMR-003-00-00-NH Aero Antenna Technology, Inc., Chatsworth, Calif.

It is contemplated that there can be a set of differently equipped scanners adapted to be coupled to the printer so that the manufacturer or the user can select and couple any one of the scanners of the printer. Two or more RFID scanners can be alternatively and selectively coupled to the printer. In particular, the set can include, for example, an ultra high frequency (UHF) antenna and a compatible RFID reader/writer, a high frequency (HF) antenna and a compatible RFID reader/writer or an antenna and a compatible RFID reader/writer operable at a different frequency.

While the printer 21 is illustrated to be a hand-held portable printer, any claim that specifies only "portable" and not "hand-held" is not limited to being a hand-held printer, as used herein. In addition, any claim that specifies neither "hand-held" nor "portable" can include a stationary or table-top printer, as used herein.

Other embodiments and modifications of the invention will suggest themselves to those skilled in the art, and all such of these as come within the spirit of this invention are included within its scope as best defined by the appended claims.

We claim:

1. A printer, comprising:

a housing having first and second housing sections movable relative to each other between an open position and a closed operating position, a print head assembly yieldably mounted to the first housing section, the print head assembly including a heat sink and a print head, the print head including a linear array of heating elements on a substrate, the substrate being secured to the heat sink, a platen roll mounted on the second housing section and cooperable with the print head to print on a web of RFID transponder-containing record members movable along a web path, and an RFID antenna on the first housing section, and the print head assembly and the antenna being coupled to yield as a unit as the housing sections are brought into the operating position.

2. A printer as defined in claim 1, including a holder for the antenna, and the holder being coupled to the heat sink and movable as a unit with the heat sink.

3. A printer as defined in claim 1, the first housing section including a first holder, at least one spring biasing the print head assembly with respect to the first holder, and a second holder for the antenna, the second holder being coupled to the heat sink and movable as a unit with the heat sink.

4. A printer, comprising:

a print head assembly including a thermal print head and a heat sink secured to the print head, a platen roll, the print head assembly and the platen roll being relatively movable between an open, spaced apart, nonoperating position and a printing position with the print head in printing cooperation with the platen roll, at least one spring to enable the print head assembly to yield when the print head assembly is moved toward the printing position, a holder connected to move in unison with the print head assembly, a circuit board mounted on the holder, the circuit board having an antenna disposed immediately upstream of the print head, the print head being capable of printing on a web of RFID transponder-containing record members movable downstream along a path past the antenna to the print head, and the print head and the antenna being on the same side of the path.

5. A printer, comprising:

a thermal print head, a first holder to yieldably mount the print head, a second holder carried by the first holder, and an RFID antenna mounted to the second holder and disposed adjacent the print head.

6. A printer, comprising:

a resiliently mounted thermal print head including a substrate and a linear array of heating elements on the substrate, the heating elements being disposed along one side of a path of travel of a web of RFID record members, an internal RFID antenna separate from the substrate and the heating elements and closely spaced with respect to the path, wherein the antenna is disposed upstream of and close to the heating elements, wherein the antenna is disposed on the one side of the path, and a platen roll disposed on the other side of the path and cooperable with the heating elements, a delaminator disposed along the path downstream of the platen roll, a hand-held portable printer housing, the printer housing having space to mount the web of labels releasably adhered to a carrier web in the form of a supply roll, the printer housing mounting the thermal print head and the internal RFID antenna, the printer housing having a downwardly extending handle, an RFID scanner housing, and an RFID antenna on the scanner housing, and the scanner housing being attached to the handle.

7. A printer as defined in claim 6, including a printer housing for the print head and the internal RFID antenna, a scanner housing on the outside of the printer housing and connected to the printer housing, and an RFID antenna on the scanner housing.

8. A printer, comprising:

a frame, a path of travel for a web of RFID transponder-containing record members, a print head disposed along one side of the path and capable of printing on the record members, an RFID antenna disposed on the same side of the web as the print head, the RFID antenna being disposed along the path upstream of the print head, the RFID antenna being close to but separate from the print head, and wherein the print head and the RFID antenna are resiliently mounted with respect to the frame.

9. A hand-held portable printer, comprising:

a hand-held portable printer housing having a manually engageable handle, the printer housing having space to mount a composite web of labels releasably adhered to a carrier web in the form of a supply roll, a print head mounted on the printer housing, a driven roll capable of advancing the composite web to the print head, an RFID scanner housing attached to the handle, an RFID antenna on the scanner housing, and a latch capable of releasably connecting an antenna housing to the printer housing.

10. A hand-held portable printer as defined in claim 9, wherein the latch is comprised of a pair of relatively movable jaws on the antenna housing engagable with the handle.

11. A hand-held portable printer as defined in claim 10, wherein the jaws are spring-urged into a latching position.

12. A hand-held portable printer as defined in claim 10, wherein the handle has internal surfaces with which the jaws can engage.

13. A hand-held portable printer as defined in claim 9, including an RFID reader/writer mounted on the scanner housing and connected to the RFID antenna.

14. A hand-held portable printer as defined in claim 13, including a battery in the handle for powering the RFID reader/writer and the print head.

15. A hand-held portable printer as defined in claim 13, including a battery on the printer housing for powering the RFID reader/writer.

16. A hand-held portable printer as defined in claim 9, including an RFID reader/writer connected to the RFID antenna, and a controller on the printer housing and coupled to the RFID reader/writer.

17. A hand-held portable printer as defined in claim 9, wherein the antenna housing is releasably latched to the handle by the latch.

18. A hand-held portable printer as defined in claim 9, wherein the antenna housing has a pair of housing portions in an angle-shaped arrangement, wherein the handle extends downwardly, wherein one housing portion underlies the handle, and wherein the other housing portion is disposed in front of the handle and contains the antenna on the antenna housing.

19. A printer, comprising:

an attachment including an RFID antenna, a hand-held portable printer housing having a handle and space to receive a supply roll of labels releasably adhered to a carrier web, a print head to print on the labels, a delaminator to delaminate printed labels from the carrier web, and a label applicator to apply printed labels, and wherein the attachment is releasably attachable to the handle at a location sufficiently remote from the applicator so as not to interfere with label application.

20. A hand-held portable printer, comprising:

a hand-held portable printer housing having a first housing section and a second housing section, the second housing section having a downwardly extending handle, a print head mounted on one of the first and second housing sections, a platen roll mounted on the other of the first and second housing sections, the first and second housing sections being relatively movable between an open position to receive a supply roll of a composite web of labels releasably adhered to a carrier web and an operating position in which the print head is in printing cooperation with the platen roll and a label, an RFID antenna housing, an RFID antenna on the antenna housing, and wherein the antenna housing is attached to the handle.

21. A hand-held portable printer as defined in claim 20, wherein the antenna housing is releasably attached to the handle.

22. A hand-held portable printer, comprising:

a hand-held portable printer housing, the printer housing having space to mount a composite web of labels releasably adhered to a carrier web in the form of a supply roll, the housing having a downwardly extending handle, a print head mounted in the printer housing, a driven roll capable of advancing the composite web to the print head, an RFID antenna housing, an RFID antenna on the antenna housing, and the antenna housing being connected to the handle.

23. A hand-held portable printer as defined in claim 22, wherein the printer housing has an exit opening through which the carrier web can exit, and the antenna housing being disposed below the exit opening.

24. A hand-held printer as defined in claim 22, wherein the antenna housing is attached to the lower region of the handle.

25. A hand-held portable printer as defined in claim 22, wherein one part of the antenna housing is disposed below the handle and another part of the antenna housing is disposed in front of the handle.

26. A hand-held portable printer as defined in claim 25, wherein the one part of the antenna housing has a pair of manually operable jaws engagable with the handle.

27. A hand-held portable printer as defined in claim 25, including an applicator on the printer housing to apply printed labels.

28. A printer, comprising:

a printer housing, a print head on the printer housing, the print head being capable of printing on a web of RFID transponder-containing record members movable along a path of web travel, an internal RFID antenna capable of communicating by radio frequency with transponders on the web, an RFID scanner housing coupled to the outside of the printer housing, an RFID reader/writer, the RFID reader/writer being disposed on the scanner housing, an external RFID antenna on the scanner housing, and wherein the internal RFID antenna and external RFID antenna are coupled to the RFID reader/writer.

29. A printer as defined in claim 28, wherein the printer housing is hand-held and portable and includes a handle, and wherein the scanner housing is attached to the handle.

30. A printer as defined in claim 28, including a latch connecting the printer housing and the scanner housing.

31. A printer as defined in claim 28, wherein the internal antenna can be comprised of either a UHF antenna or a HF antenna.

32. A printer as defined in claim 28, wherein the external antenna can be comprised of either a UHF antenna or an HF antenna.

33. A printer as defined in claim 28, wherein the internal and external antennas can be of either the UHF type or the HF type.

34. A printer as defined in claim 28, wherein there is only one RFID reader/writer.

35. A printer, comprising:

a printer housing, a print head on the printer housing, the print head being capable of printing on a web of RFID transponder-containing record members movable along a path of web travel, an internal RFID antenna capable of communicating with transponders on the web, a set of at least two selectable RFID scanners anyone of which is capable of being coupled to the printer housing, one of the RFID scanners including an external antenna and an external RFID reader/writer capable of reading and/or writing to UHF transponders external to the printer housing, another one of the RFID scanners including an external antenna and an external RFID reader/writer capable of reading and/or writing to HF transponders external to the printer housing, and the internal antenna being capable of being coupled to the RFID reader/writer on the selected RFID scanner.

36. Method of converting a hand-held portable printer into a hand-held portable printer with an RFID scanner, comprising:

providing a hand-held portable printer having a handheld portable housing with a handle and a print head capable of printing on a web of labels, providing a scanner housing having an RFID antenna for an RFID reader/writer capable of reading and/or writing to RFID transponders outside the printer, and releasably attaching the scanner housing to the handle.

37. Method of converting a printer into an RFID printer capable of RFID reading and/or writing to a transponder outside the printer, comprising:

providing a printer having an internal RFID antenna capable of RFID communication with transponders on the web, providing an external RFID scanner having an external antenna and an external RFID reader/writer, and releasably coupling the RFID scanner to the internal antenna.

38. Method as defined in claim 37, wherein the printer is a portable printer.

39. Method of converting a printer with an RFID antenna for reading and/or writing to a web of RFID transponder containing record members into an RFID printer capable of RFID reading and/or writing to a transponder outside the printer, comprising:

providing a printer having an internal RFID antenna capable of RFID communication with transponders on the web, providing an external RFID scanner having an external antenna and an RFID reader/writer, and releasably attaching the RFID scanner to the printer including coupling the RFID scanner to the internal antenna.

40. Method as defined in claim 39, wherein the printer is a portable printer.

41. Apparatus, comprising:

a printer including a print head capable of printing on a web of RFID transponder-containing record members movable along a path of web travel, an internal RFID antenna capable of communicating by radio frequency with transponders on the web, and an RFID scanner external to the printer having an external antenna and an external RFID reader/writer coupled to the external antenna, and the RFID scanner being coupled to the internal antenna.

42. A printer as defined in claim 41, wherein the external RFID reader/writer is coupled to the internal antenna.

43. A printer as defined in claim 41, wherein the RFID scanner is attached to the printer.

* * * * *